United States Patent [19]

Sonoda et al.

[11] Patent Number: 4,807,576

[45] Date of Patent: Feb. 28, 1989

[54] HYDRAULIC LASH ADJUSTER FOR USE IN VALVE OPERATING MECHANISM

[75] Inventors: Toshinari Sonoda; Toshihiko Matsubara; Takashi Otowa; Kazuo Yoshida, all of Saitama, Japan

[73] Assignee: Honda Giken Kogyo Kabushiki Kaisha, Tokyo, Japan

[21] Appl. No.: 919,027

[22] Filed: Oct. 15, 1986

[30] Foreign Application Priority Data

Oct. 15, 1985 [JP] Japan ..... 60-157198[U]
Oct. 15, 1985 [JP] Japan ..... 60-157199[U]
Oct. 16, 1985 [JP] Japan ..... 60-230852

[51] Int. Cl.[4] ..... F01L 1/24

[52] U.S. Cl. ..... 123/90.57; 123/90.44; 123/90.43

[58] Field of Search ..... 123/90.39, 90.41, 90.43, 123/90.44, 90.45, 90.46, 90.55, 90.57, 90.63

[56] References Cited

U.S. PATENT DOCUMENTS

| | | | |
|---|---|---|---|
| 3,273,548 | 9/1966 | Hoffman | 123/90.44 |
| 3,690,958 | 9/1972 | Thompson | 123/90.44 |
| 4,184,464 | 1/1980 | Svihlik | 123/90.57 |
| 4,524,731 | 6/1985 | Rhoads | 123/90.57 |
| 4,541,373 | 9/1985 | Ishida | 123/90.46 |
| 4,596,213 | 6/1986 | Hillebrand | 123/90.46 |
| 4,601,268 | 7/1986 | Rhoads | 123/90.57 |
| 4,602,597 | 7/1986 | Rhoads | 123/90.63 |
| 4,741,298 | 5/1988 | Rhoadas | 123/90.57 |

*Primary Examiner*—Willis R. Wolfe, Jr.
*Assistant Examiner*—M. Macy
*Attorney, Agent, or Firm*—Lyon & Lyon

[57] ABSTRACT

A valve operating mechanism for operating a valve in an internal combustion engine includes a hydraulic lash adjuster for imposing a hydraulic pressure against a cam follower slidably engaging a camshaft. The hydraulic lash adjuster includes a plunger slidably disposed in a cylinder and defining an oil chamber communicating with a pressure chamber between the plunger and the cylinder through a valve hole which can selectively be opened and closed by a free-ball check valve. The plunger is normally urged by a spring to move in a direction out of the cylinder toward the cam follower. The cam follower acts on an end of the valve stem of the valve through an interlink mechanism having an adjusting device for adjusting the volume of the pressure chamber of the hydraulic lash adjuster.

8 Claims, 6 Drawing Sheets

HYDRAULIC LASH ADJUSTER FOR USE IN VALVE OPERATING MECHANISM

The present invention relates to an internal combustion engine, and more particularly to a hydraulic lash adjuster for use in a valve operating mechanism in an internal combustion engine.

Japanese Laid-Open Patent Publication No. 60 (1985)-35106 discloses a valve operating mechanism having hydraulic lash adjusters in an internal combustion engine. The valve operating mechanism includes cam followers operated by a single overhead camshaft for reciprocally actuating intake and exhaust valves. Some of the cam followers act directly on the cam stems of intake valves, whereas the other cam followers act on the cam stems of exhaust valves through respective interlink mechanisms including pusher rods. The hydraulic lash adjusters are employed to eliminate any gap which would be created between the cam followers and ends of the valve stems of the intake and exhaust valves. The valve operating mechanism of this type is advantageous in that the hydraulic lash adjusters include plungers that are movable back and forth to absorb the manufacturing errors of various components of the valve operating mechanism. With the interlink mechanism used between one cam follower and the corresponding valve stem, the number of components required is large, and so are accumulated machining errors of these components. Therefore, the plunger of the hydraulic lash adjuster is required to move back and forth over a large stroke to make up for the accumulated machining errors, resulting in a corresponding large change in the volume of the hydraulic pressure chamber defined in the hydraulic lash adjuster.

The inventors have conducted experiments to determine how the volume of the hydraulic pressure chamber of a hydraulic lash adjuster affects the performance of a valve operating mechanism. The results of the experiments are illustrated in FIGS. 2 and 3 of the accompanying drawings.

FIG. 2 shows the relationship between the hydraulic pressure chamber volume and the compressive pressure in the combustion chamber of the internal combustion engine at a temperature of −20° C. in a cranking speed range below a normal idling speed It will be understood from FIG. 2 that if the volume of the hydraulic pressure chamber is smaller than a certain level, the compressive pressure in the combustion chamber drops abruptly. The reason for this is that since the viscosity of oil in the hydraulic pressure chamber is increased at the low temperature, almost no oil flows from the hydraulic pressure chamber when a load is imposed on the plunger of the hydraulic lash adjuster. Therefore, the interval or stroke that the plunger is retracted or plunges is so small that the plunger cannot absorb radial displacements of the rotating camshaft, thus causing a corresponding intake or exhaust valve to fail to be closed properly.

FIG. 3 shows the relationship between the volume of the hydraulic pressure chamber and the limit speed of rotation of the engine above which the valve is caused to bound off its valve seat. FIG. 3 clearly indicates that if the volume of the hydraulic pressure chamber is larger than a certain level, the valve tends to be easily bounced off the valve seat. This is because the spring constant of the entire valve operating mechanism is lowered by an increase in the volume of the hydraulic pressure chamber.

These experimental results show that the volume of the hydraulic pressure chamber of the hydraulic lash adjuster should be of a certain appropriate value in order to operate the valve operating mechanism properly.

The hydraulic lash adjuster of the type described above is disclosed in Japanese Laid-Open Patent Publication No. 58(1983)-210309, for example. When the engine is at a high temperature during its operation, the viscosity of the oil in the hydraulic pressure chamber is lowered to allow the plunger to retract an increased depth when subjected to a load. This condition occurs to an even greater degree when the engine is started at a high temperature and operates in a cranking speed range, i.e., before the engine speed reaches a normal idling speed of about 700 rpm, because the speed at which intake and exhaust valves are opened is very low and so are the load imposed on the plunger and the speed of movement thereof. Therefore, the low viscosity oil leaks from the hydraulic pressure chamber through the gap between the plunger and the cylinder in which the plunger is slidably disposed, thus causing the plunger to retract a stroke that may be several times larger than the normal stroke. Heretofore, the oil that has leaked from the hydraulic pressure chamber is discharged out of the cylinder and an oil chamber defined in the hydraulic lash adjuster is required to contain a large amount of oil which is to be supplied into the hydraulic pressure chamber when the plunger is extended upon release from the load. To meet this requirement, the oil pump employed for feeding oil to the oil chamber must be of a large capacity.

The prior art hydraulic lash adjuster includes a check valve which is normally closed by a spring. The spring-loaded check valve is already closed before a compressive load is applied to the plunger. At a low temperature, the viscosity of oil in the hydraulic lash adjuster is high and substantially no oil leaks from the hydraulic pressure chamber through the gap between the plunger and the cylinder. Consequently, any initial stroke that the plunger retracts under a compressive load is extremely small. If the camshaft is radially displaced by manufacturing errors of components of the valve operating mechanism during compression and power strokes of the engine, the intake or exhaust valve associated with the hydraulic lash adjuster is caused to remain lifted off the valve seat. When this happens, the engine will not start well at a low temperature.

The above problem would be solved by increasing the volume of the hydraulic pressure chamber to increase the initial stroke that the plunger would retract under a compressive load. However, increasing the volume of the hydraulic pressure chamber is not desirable for the reason described above and leads to a larger size of the hydraulic lash adjuster. In addition, the rigidity of the valve operating mechanism is lowered to cause the intake and exhaust valves to jump or bounce off their valve seats.

SUMMARY OF THE INVENTION

It is an object of the present invention to provide a valve operating mechanism including means for adjusting the volume of the hydraulic pressure chamber of a hydraulic lash adjuster to an appropriate level even if accumulated machining errors of components of the valve operating mechanism are large.

Another object of the present invention is to provide a hydraulic lash adjuster, in such a valve operating mechanism, which is constructed to consume a reduced amount of oil so that the capacity of an oil pump for feeding oil to the hydraulic lash adjuster may be small.

Still another object of the present invention is to provide a hydraulic lash adjuster, in such a valve operating mechanism, which enables an engine to be started well at a low temperature, is small in size, and allows the valve operating mechanism to be of high rigidity.

According to the present invention, there is provided a valve operating mechanism for operating a valve in an internal combustion engine which includes an interlink mechanism engaging a cam follower for transmitting motion from the cam follower to the valve, the interlink mechanism including an adjusting device for adjusting the volume of a pressure chamber defined in a hydraulic lash adjuster for applying a hydraulic pressure on the cam follower.

The adjusting device comprises an adjustment bolt threaded through an end of a rocker arm for abutting engagement with the end of the valve stem of the valve, and a lock nut threaded over the adjustment bolt for fixing the adjustment bolt with respect to the rocker arm.

The hydraulic lash adjuster comprises a cylinder having a bottom, a plunger slidably disposed in the cylinder and engaging the cam follower, the plunger having an oil chamber therein, a pressure chamber being defined between the cylinder and the plunger at the bottom of the cylinder, the plunger having a valve hole providing fluid communication between the oil chamber and the pressure chamber, the plunger and the cylinder having oil holes defined in side walls thereof and providing fluid communication between the oil chamber and an oil distribution passage, a check valve disposed in the pressure chamber for selectively opening and closing the valve hole in reduction and an increase, respectively, in oil pressure in the pressure chamber, and a spring disposed in the pressure chamber for normally urging the plunger in a direction out of the cylinder toward the cam follower.

The plunger has an oil return hole defined in a side wall thereof and positioned axially between the oil hole of the plunger and the pressure chamber and an annular passage defined in an outer peripheral surface of the plunger and communicating with the oil return passage and with a gap between the plunger and the cylinder.

It is preferred that the pressure chamber have the following dimensional relationship:

$$2 \leqq D/L \leqq 4$$

where D is the diameter of the pressure chamber and L is the height of the pressure chamber.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
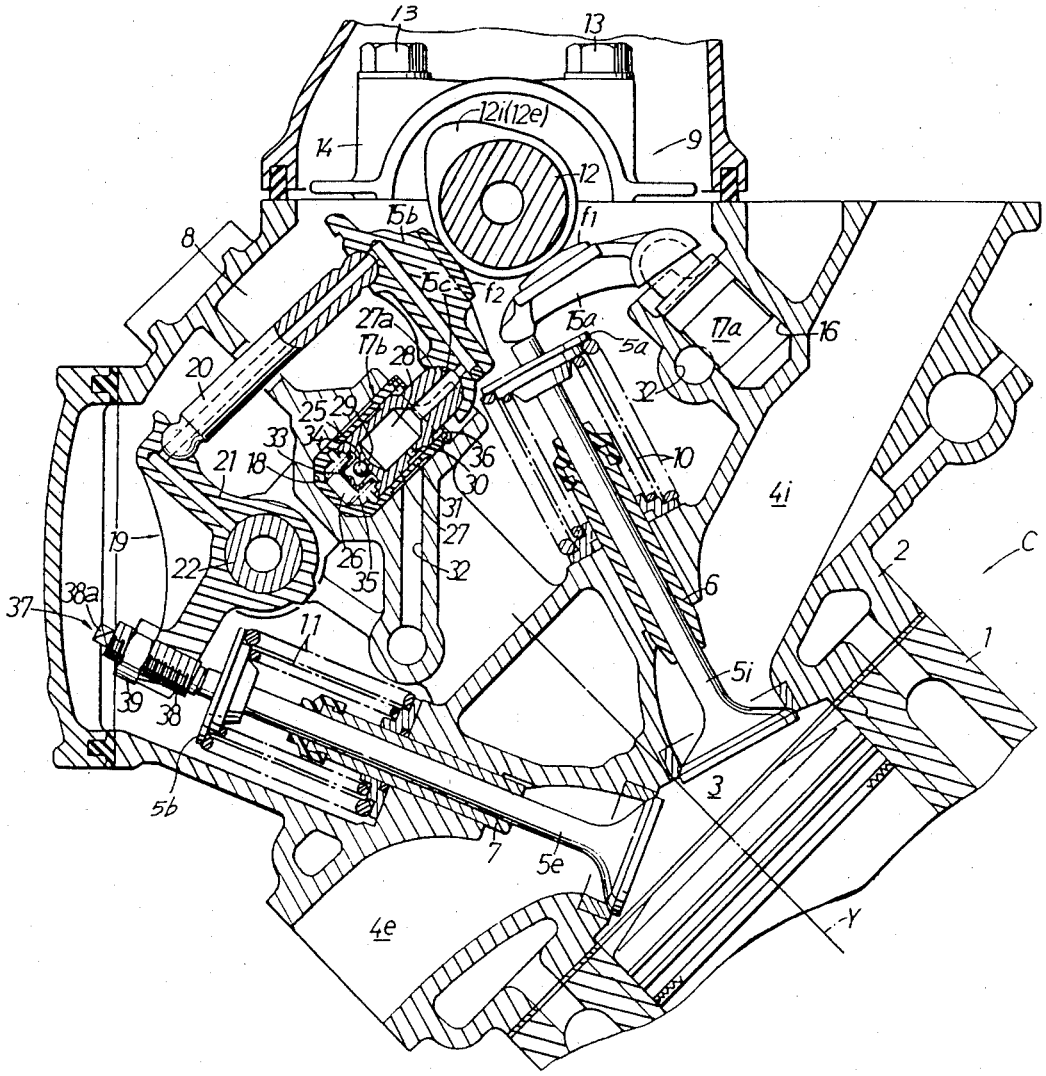
FIG. 1 is a fragmentary vertical cross-sectional view of a cylinder head of an internal combustion engine incorporating a valve operating mechanism according to the present invention.
Figure 2:
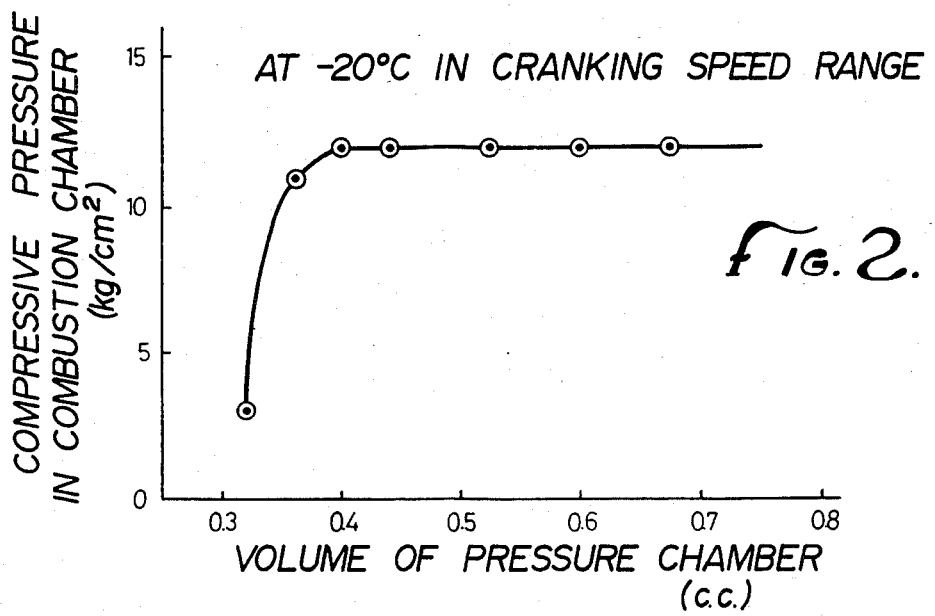
FIG. 2 is a graph showing the relationship between the volume of the hydraulic pressure chamber defined in a hydraulic lash adjuster and the compressive pressure in a combustion chamber in an engine at a low temperature.
Figure 3:
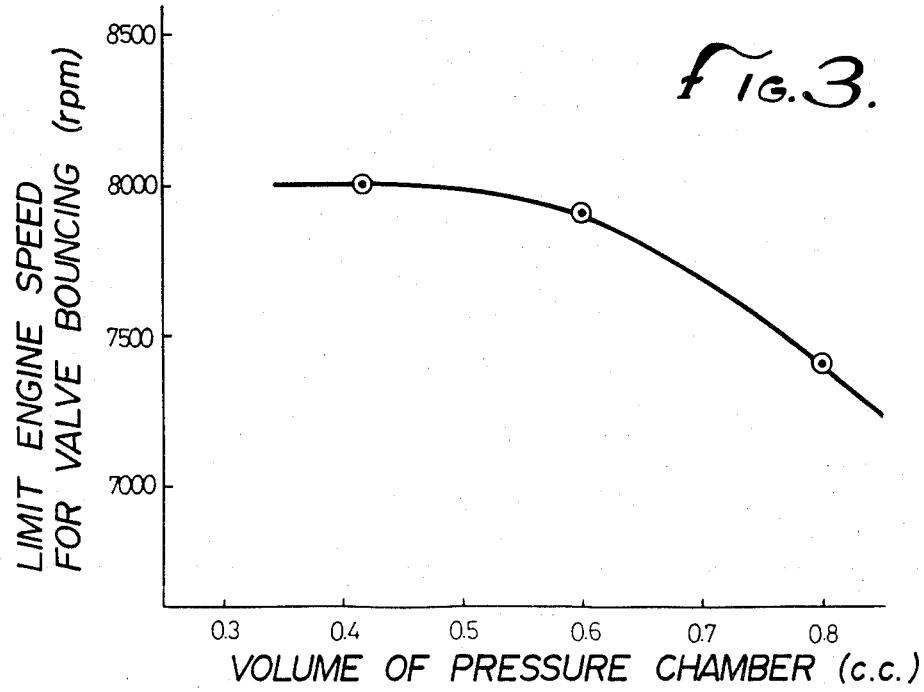
FIG. 3 is a graph showing the relationship between the volume of the hydraulic pressure chamber defined in a hydraulic lash adjuster and the engine speed above which a valve associated with the hydraulic lash adjuster is caused to bounce off its valve seat.

Like or corresponding parts are denoted by like or corresponding reference characters throughout the several views and for the different embodiments.

FIG. 1 shows one cylinder array or bank C of a V-shaped multicylinder internal combustion engine. The cylinder bank C generally comprises a cylinder block 1 and a cylinder head 2 fastened to the upper end of the cylinder block 1.

The cylinder head 2 has an array of combustion chambers 3 (only one shown) and intake and exhaust ports **4*i*, 4*e* opening into each of the combustion chambers 3. The intake and exhaust ports 4*i*, 4*e* can be opened and closed by intake and exhaust valves 5*i*, 5*e*, respectively, slidably supported by valve guides 6, 7 mounted in the cylinder head 2. The intake and exhaust valves 5*i*, 5*e* are inclined to the axis Y of the cylinder so that the upper ends of the valves 5*i*, 5*e*** are widely spaced from each other.

The intake and exhaust valves **5*i*,5*e* are operated by a valve operating mechanism 9 disposed in a chamber 8 defined in the cylinder head 2. The valve stems of the intake and exhaust valves 5*i*, 5*e* extend upwardly into the chamber 8. Valve springs 10, 11 are disposed around the valve stems and held under compression between retainers 5*a*, 5*b* and cylinder head members for normally urging the intake and exhaust valves 5*i*, 5*e* in a direction to close the intake and exhaust ports 4*i*, 4*e*. A single camshaft 12 is disposed above the intake valve 5*i* and rotatably supported by the cylinder head 2 and a cam holder assembly 14 fastened thereto by bolts 13. The camshaft 12 has a plurality of cams 12*i*, 12*e* for operating the intake and exhaust valves 5*i*, 5*e*, respectively. First and second cam followers 15*a*, 15*b* are disposed underneath the camshaft 12 in a substantially V-shaped configuration and have respective slipper surfaces f1, f2 held in sliding contact with the cams 12*i*, 12*e***, respectively, at their lower portions.

The first cam follower **15*a* has an upper end angularly movably supported by a first hydraulic lash adjuster 17*a* mounted in a hole 16 defined in the cylinder head 2. The lower end of the first cam follower 15*a* is held against the upper end of the valve stem of the intake valve 5*i***.

The second cam follower **15*b* has a lower end angularly movably supported by a second hydraulic lash adjuster 17*b* mounted in a hole 18** defined in the cylinder head 2. The upper end of the second cam follower 15*b* acts on the upper end of the valve stem of the intake valve 5*e* through an interlink mechanism 19.

The interlink mechanism 19 comprises a pusher rod 20 having one end engaging the upper end of the second cam follower 15*b*, and a bellcrank-shaped rocker arm 21 having an upper end engaging the opposite end of the pusher rod 20 and a lower end engaging the upper end of the valve stem of the exhaust valve 5*e* through an adjusting device 37. The rocker arm 21 is pivotably supported by a rocker shaft 22 in the cylinder head 2.

The adjusting device 37 comprises an adjustment bolt 38 adjustably threaded through the lower end of the rocker arm 21 toward and held against the upper end of the valve stem of the exhaust valve 5*e*, and a lock nut 39 by which the adjustment bolt 38 is fastened to the rocker arm 21 for fixing the adjustment bolt 38 in its adjusted position with respect to the rocker arm 21. The adjustment bolt 38 has a tool knob 38*a* with which a suitable tool (not shown) is engageable for turning the adjustment bolt 38.

There are as many first hydraulic lash adjusters 17*a* as the number of the intake valves 5*i*, and there are as many second hydraulic lash adjusters 17*b* as the number of the exhaust valves 5*e*. The first and second hydraulic lash adjusters 17*a*, 17*b* are positioned at spaced horizontal intervals in alignment with the cylinders of the cylinder bank C.

During operation of the engine, the camshaft 12 in the cylinder bank C is operated by a crankshaft (not shown) through a suitable synchronous power transmission mechanism (not shown) such as a belt-and-pulley mechanism.

Since the fist and second hydraulic lash adjusters 17*a*, 17*b* are of an identical structure, only the second hydraulic lash adjuster 17*b* will be described with reference to FIG. 1.

The second hydraulic lash adjuster 17*b* mainly comprises a bottomed cylinder 25 disposed in the hole 18, and a plunger 27 slidably fitted in the bottomed cylinder 25 and defining a hydraulic pressure chamber 26 in the cylinder 25. The plunger 27 has an outer hemispherical end 27*a* engaging a hemispherical cavity 15*c* defined in the lower end of the cam follower 15*b*. The plunger 27 has an oil chamber 28 defined therein and a valve hole 29 which provides fluid communication between the pressure chamber 26 and the oil chamber 28. The oil chamber 28 communicates with an oil distribution passage 32 through an oil hole 30 defined in a side wall of the plunger 27 and an oil hole 31 defined in a side wall of the cylinder 25 in radial registration with the oil hole 30. The oil chamber 28 is always filled with oil fed from the oil distribution passage 32.

A hat-shaped valve cage 33 is attached to the lower end of the plunger 27 and loosely accommodates therein a free check valve ball 34 for opening and closing the valve hole 29. The check valve ball 34 is movable in a stroke which is limited by the valve cage 33. The check valve ball 34 opens the valve hole 29 when the oil pressure in the pressure chamber 26 is reduced, and closes the valve hole 29 when the oil pressure in the pressure chamber 26 is increased. A compression coil spring 35 is housed in the pressure chamber 26 for normally urging the plunger 27 in a direction to move upwardly out of the cylinder 25 through its open end. The spring-biased outward movement of the plunger 27 is limited by an annular stopper 36 mounted on the open end of the cylinder 25.

Operation of the valve operating mechanism 9 thus constructed is as follows: While the engine is in operation, the camshaft 12 is rotated about its own axis by the crankshaft via the non-illustrated synchronous power transmission mechanism. When an intake stroke is started, the first cam follower, 15*a* is swung downwardly by the cam 12*i* about the first hydraulic lash adjuster 17*a* to open the intake valve 5*i* against the resiliency of the springs 10, which then allows an air-fuel mixture to be introduced from the intake port 4*i* into the combustion chamber 3. When an exhaust stroke is started, the second cam follower 15*b* is swung by the cam 12*e* about the second hydraulic lash adjuster 17*b* to push the pusher rod 20, angularly pivoting the rocker arm 21 to move the exhaust valve 5*e* in a direction to open the same against the resiliency of the springs 11. An exhaust gas is now discharged passed the exhaust valve 5*e* from the combustion chamber 3 into the exhaust port 4*e*.

At this time, the second hydraulic lash adjuster 17*b* operates to eliminate any gap between the upper end of the valve stem of the exhaust valve 5*e* and the adjustment bolt 38. More specifically, when the second cam follower 15*b* is swung by the cam lobe of the cam 12*e*, the plunger 27 is pushed by the second cam follower 15*b* toward the pressure chamber 26, and a small amount of oil flows from the pressure chamber 26 through the valve hole 29 into the oil chamber 28 to allow the plunger 27 to be initially depressed to a certain extent. Thereafter, the check valve ball 34 closes the valve hole 29 to develop an oil pressure in the pressure chamber 26 for enabling the plunger 27 to produce a bearing force to support the lower end of the second cam follower 15*b*. As a result, the second cam follower 15*b* is angularly pivoted about the hemispherical end 27*a* of the plunger 27 in the direction to push the pusher rod 20 thereby to open the exhaust valve 5*e*.

When the cam 12*e* moves past the cam lobe of the second cam follower 15*b*, the second cam follower 15*b* returns to permit the exhaust valve 5*e* to close the exhaust port 4*e* under the resilient force of the springs 11. The plunger 27, which is released of the load from the cam follower 15*b*, is now lifted under the resiliency of the spring 35 to cause the slipper surface f2 of the second cam follower 15*b* to engage the cam 12*e*. Thus, any gap is prevented from being created between the upper end of the valve stem of the exhaust valve 5*e* and the adjustment bolt 38.

As the plunger 27 is lifted by the spring 35, the oil pressure in the pressure chamber 26 is lowered to open the check valve 34 to introduce oil from the oil chamber 28 through the valve hole 29 into the pressure chamber 26, thus making up for the previous oil discharge from the pressure chamber 26.

When the camshaft 12 is radially displaced toward the second cam follower 15*b* due to any off-center movement or flexing movement while the exhaust valve 5*e* is being closed, the plunger 27 is depressed to an initial depth, as described above, to absorb such radial displacement of the camshaft 12. Consequently, the exhaust valve 5*e* remains closed irrespective of the radial displacement of the camshaft 12. The exhaust valve 5*e* is thus prevented from being lifted off the valve seat even at a low temperature, and the engine can be started well under low-temperature conditions.

Inasmuch as the interlink mechanism 19 has many components, accumulated machining errors thereof are relatively large. To prevent such accumulated machining errors from excessively reducing or increasing the volume of the pressure chamber 26 of the second hydraulic lash adjuster 17*b*, the adjusting device 37 is operated while the engine is not in operation, as follows:

The adjustment bolt 38 is turned so as to be retracted away from the exhaust valve 5*e*. The interlink mechanism 19 is therefore moved in a direction to permit the plunger 27 of the second hydraulic lash adjuster 17*b* to be lifted under the force of the spring 35 to its upper stroke limit, whereupon the plunger 27 is stopped by engagement with the annular stopper 36. Then, the adjustment bolt 38 is turned in the opposite direction to move toward the exhaust valve 5*e*. At the time when there are no longer any gaps or backlash between the components of the interlink mechanism 19, the adjustment bolt 38 is additionally turned through a given number of turns to move toward the exhaust valve 5*e* for pushing the plunger 27 a prescribed interval into the pressure chamber 26 from the upper stroke limit against the resiliency of the spring 35. The volume of the pressure chamber 26 is now adjusted to an appropriate level irrespective of the machining errors of the parts of the interlink mechanism 19. After the adjustment has been made, the lock nut 39 is fastened to fix the adjustment bolt 38 with respect to the rocker arm 21.

With the volume of the pressure chamber 26 thus appropriately adjusted, the plunger 27 can be depressed a prescribed initial interval upon application of a load from the exhaust cam 12*e* even at a low temperature when the viscosity of the oil in the pressure chamber 26 is high. The plunger 27 can therefore absorb radial displacements of the rotating camshaft 12 to assure that the exhaust valve 5*e* is fully closed. Furthermore, the spring constant of the entire valve operating mechanism 9 remains relatively large to prevent the exhaust valve 5*e* from bouncing off its valve seat in a normal engine speed range.

The adjusting device 37 may be located anywhere in the interlink mechanism 19 as long as it can adjust the volume of the pressure chamber 26 of the second hydraulic lash adjuster 17*b*. Although not shown, a mechanism similar to interlink mechanism 19 also may be used to operatively couple the cam 12 to the intake valve 5*i*.

Figure 4:
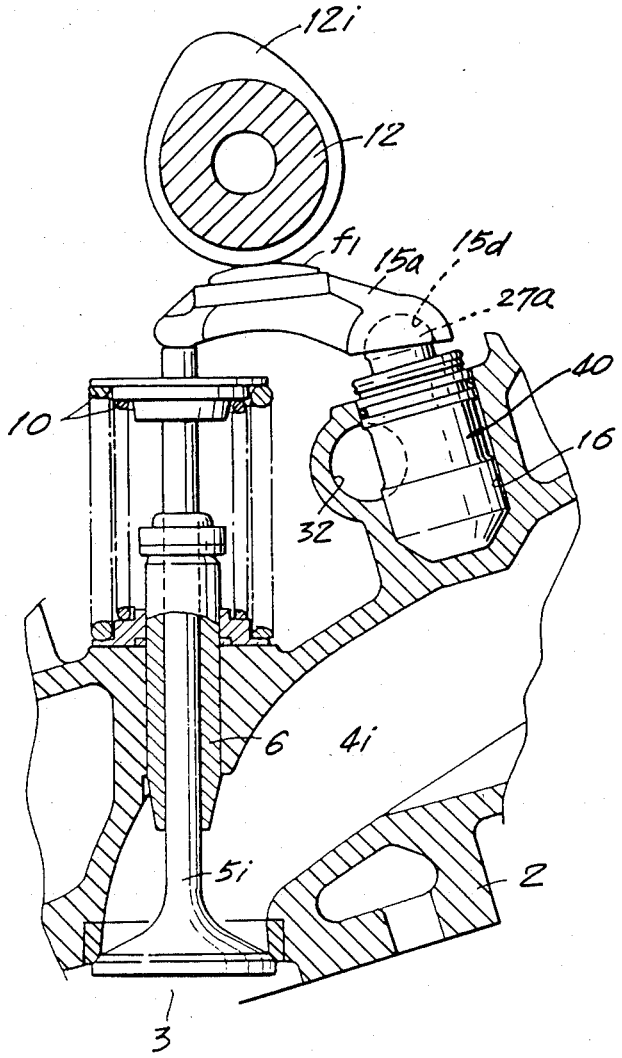
FIG. 4 is a fragmentary cross-sectional view of a valve operating mechanism employing a hydraulic lash adjuster according to another embodiment of the present invention and a valve operatively coupled thereto.
Figure 5:
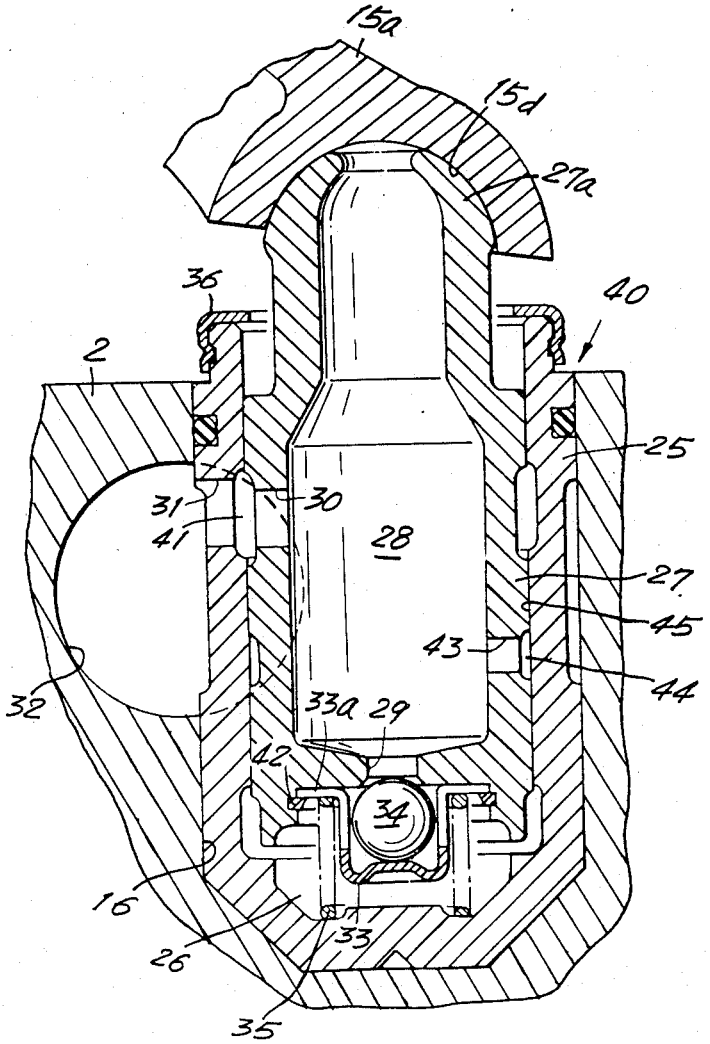
FIG. 5 is an enlarged cross-sectional view of the hydraulic lash adjuster shown in FIG. 4.

FIGS. 4 and 5 illustrate a hydraulic lash adjuster 40 according to another embodiment of the present invention, the hydraulic lash adjuster 40 being operatively coupled to the intake valve 5*i*. Since the hydraulic lash adjuster 40 is substantially similar to the hydrauliclash adjusters 17*a* and 17*b* shown in FIG. 1, only different structural details will be described below. As shown in FIG. 5, the oil hole 30 defined in the side wall of the plunger 27 and the oil hole 31 defined in the side wall of the cylinder 25 are always in communication with each other through an annular passage 41 defined between the plunger 27 and the cylinder 25. The hat-shaped valve cage 33 has a flange 33*a* which is anchored in place to the plunger 27 by a retainer ring 42.

The plunger 27, with its hemispherical end 27*a* fitted in a hemispherical cavity 15*d* in the cam follower 15*a*, has an oil return hole 43 defined in a side wall thereof in fluid communication with an annular passage 44 defined in the outer peripheral surface of the plunger 27 and axially spaced from the annular passage 41 toward the pressure chamber 26. The oil chamber 28 communicates through the oil return hole 43 and the annular passage 44 with a clearance gap 45 between the cylinder 25 and the plunger 27 slidably fitted in the cylinder 25.

While the cam follower 15*a* is being supported by the plunger 27 under the hydraulic pressure in the pressure chamber 26, oil tends to leak from the pressure chamber 26 into the gap 45 between the plunger 27 and the cylinder 25. However, such leaked oil flows from the annular passage 44 close to the pressure chamber 26 through the oil return hole 43 into the oil chamber 28. Therefore, wasteful consumption of leaked oil is prevented.

Figure 6:
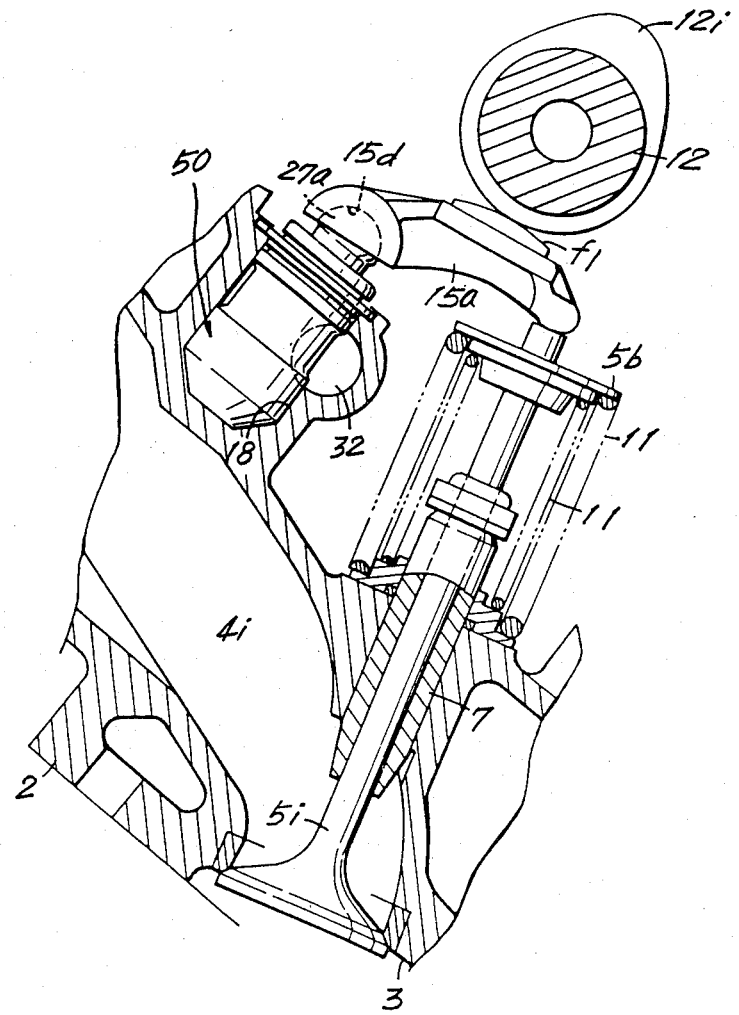
FIG. 6 is a fragmentary cross-sectional view of a valve operating mechanism employing a hydraulic lash adjuster according to still another embodiment of the present invention.
Figure 7:
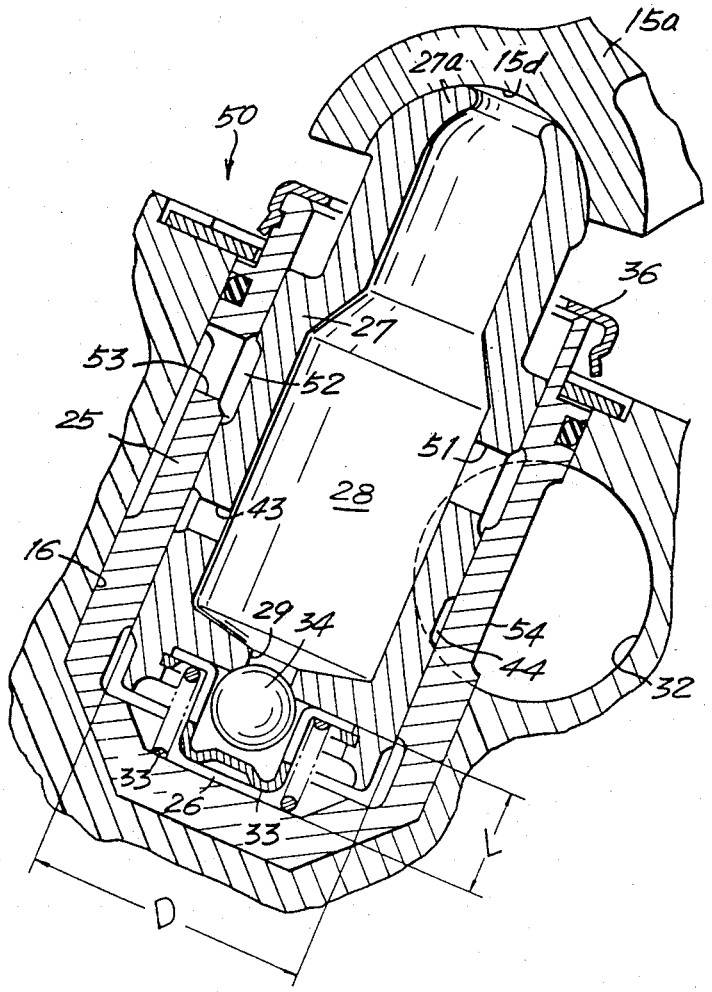
FIG. 7 is an enlarged cross-sectional view of the hydraulic lash adjuster shown in FIG. 6.

FIGS. 6 and 7 show a hydraulic lash adjuster 50 according to still another embodiment of the present invention, the hydraulic lash adjuster 50 being shown as being operatively coupled to the intake valve 5*i*. As shown in FIG. 7, the hydraulic lash adjuster 50 differs from the hydraulic lash adjuster 40 of FIG. 5 in that the oil chamber 28 communicates with the oil distribution passage 32 through an oil hole 51 defined in a side wall of the plunger 27, an annular passage 52 defined between the plunger 27 and the cylinder 25 and communicating with the oil hole 51, an oil hole 53 defined in a side wall of the cylinder 25 in diametrically opposite relation to the oil hole 51 and communicating with the annular passage 52, and an annular passage 54 defined in an outer peripheral surface of the cylinder 25 in communication with the oil hole 53 and opening into the oil distribution passage 32.

The pressure chamber 26 is of a relatively flat configuration so that its dimensions are within the relationship of $2 \leqq D/L \leqq 4$ where D is the diameter of the pressure chamber 26 (i.e., the inside diameter of the cylinder 25) and L is the height of the pressure chamber 26.

The displacement, or spring constant k, of the hydraulic lash adjuster 50 under the load on the pressure chamber 26 is generally expressed by:

$$k=\alpha(D^4/V)$$

where $\alpha$: coefficient (mainly dependent on the oil viscosity);

D: diameter of the pressure chamber; and

V: volume of the pressure chamber.

The spring constant k governs the rigidity of the valve operating mechanism which employs the hydraulic lash adjuster 50. The greater the spring constant k, the higher the rigidity of the valve operating mechanism, and the higher the engine speed above which the exhaust valve 5*e* is apt to jump or bounce off its valve seat. Therefore, the greater the spring constant k, the less the exhaust valve 5*e* is liable to jump or bounce off its valve seat.

Assuming that the volume V is constant, the spring constant k can be increased by increasing the ratio D/L. If the spring constant k were excessively large, the stroke, through which the plunger 27 is slidingly moved would be smaller than a practical level. In view of this, the ratio D/L should preferably be in the range of $2 \leqq D/L \leqq 4$.

The flat configuration of the pressure chamber 26 also contributes to a reduction of the overall height of the hydraulic lash adjuster 50.

Although certain preferred embodiments have bee shown and described, it should be understood that many changes and modifications may be made therein without departing from the scope of the appended claims.

What is claimed:

1. A hydraulic lash adjuster for use in a valve operating mechanism in an internal combustion engine, comprising:

a cylinder containing a longitudinal bore having a bottom;

a plunger slidably disposed in a clearance gap in said cylinder bore;

a pressure chamber formed between the bottom of said cylinder bore and said plunger, wherein said pressure chamber meets the dimensional relationship $2<D/L<4$, wherein D is the diameter of the pressure chamber and L is the height of the pressure chamber;

an axially elongated oil chamber in said plunger;

said plunger and said cylinder having mutually communicating oil supply holes in the side walls thereof providing fluid communication between said oil chamber and an oil distribution passage exteriorly of said cylinder;

a valve hole in said plunger providing fluid communication between said oil chamber and said pressure chamber;

check valve means for selectively opening or closing said valve hole in response to a reduction or an increase, respectively, in oil pressure in said pressure chamber;

spring means for normally urging said plunger outwardly of said cylinder bore; and means for returning oil leaked from said pressure chamber to said chamber.

2. A valve operating mechanism according to claim 1 wherein said leaked oil returning means further includes means forming an annular recess about the outer peripheral surface of said plunger communicating with said oil return hole and with said clearance gap.

3. A valve operating mechanism according to claim 1 wherein said check valve means includes a valve cage disposed in said pressure chamber and fixed to said plunger, and a valve ball for opening or closing said valve hole loosely housed in said valve cage.

4. A valve operating mechanism according to claim 1, wherein said oil supply holes of said plunger and said cylinder are held in mutual radial alignment and communicate with each other through an annular passage defined between said plunger and said cylinder.

5. A valve operating mechanism according to claim 1, wherein said oil supply holes of said plunger and said cylinder are positioned in diametrically opposite relation to each other and communicate with each other through an annular passage defined between said plunger and said cylinder.

6. A valve operating mechanism according to claim 1, wherein said cylinder has an annular passage defined in an outer peripheral surface thereof and communicating with said oil hole of said cylinder and with the oil distribution passage.

7. A hydraulic lash adjuster for use in a valve operating mechanism in an internal combustion engine, comprising a cylinder means having a closed bottom, a plunger means slidably disposed in said cylinder means and having an oil chamber, a pressure chamber having a diameter of at least two times but no more than four times greater than its height defined between said plunger means and said closed bottom of the cylinder means, check valve means between said oil chamber and said pressure chamber for checking oil flow from said pressure chamber to said oil chamber, means urging said plunger means away from said closed bottom relative to said cylinder means, means for continually supplying oil to said oil chamber, and means for receiving oil under pressure leaking from said pressure chamber and for conducting it into said oil chamber for minimizing the quantity of oil required from said means for continually supplying oil to said oil chamber.

8. The device of claim 7 wherein said means for receiving and conducting oil comprises an annular passage between said cylinder means and plunger means adjacent said pressure chamber and an opening communicating said annular passage with the oil chamber.

* * * * *